US011189237B2

(12) United States Patent
Pan et al.

(10) Patent No.: US 11,189,237 B2
(45) Date of Patent: Nov. 30, 2021

(54) CURRENT COMPENSATION CIRCUIT, VIRTUAL REALITY DEVICE AND CONTROL METHOD

(71) Applicants: Beijing BOE Optoelectronics Technology Co., Ltd., Beijing (CN); BOE Technology Group Co., Ltd., Beijing (CN)

(72) Inventors: Feng Pan, Beijing (CN); Hao Zhang, Beijing (CN); Lili Chen, Beijing (CN); Jian Sun, Beijing (CN); Yakun Wang, Beijing (CN); Yuanyuan Du, Beijing (CN); Jinghua Miao, Beijing (CN); Yu Lei, Beijing (CN); Xinjian Liu, Beijing (CN); Ziqiang Guo, Beijing (CN); Bin Zhao, Beijing (CN); Ruifeng Qin, Beijing (CN); Feng Zi, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 17 days.

(21) Appl. No.: 16/609,342

(22) PCT Filed: Apr. 4, 2019

(86) PCT No.: PCT/CN2019/081478
§ 371 (c)(1),
(2) Date: Oct. 29, 2019

(87) PCT Pub. No.: WO2019/096735
PCT Pub. Date: Oct. 17, 2019

(65) Prior Publication Data

US 2020/0058257 A1 Feb. 20, 2020

(30) Foreign Application Priority Data

Apr. 8, 2018 (CN) ..... 201810318225.X

(51) Int. Cl.
*G09G 3/34* (2006.01)
*G09G 3/36* (2006.01)
(Continued)

(52) U.S. Cl.
CPC ..... *G09G 3/3406* (2013.01); *G09G 3/36* (2013.01); *H05B 45/20* (2020.01); *H05B 45/37* (2020.01);
(Continued)

(58) Field of Classification Search
CPC .... G09G 3/3406; G09G 3/36; G09G 2320/02; G09G 2330/02; H05B 45/37; H05B 45/20
See application file for complete search history.

(56) References Cited

U.S. PATENT DOCUMENTS

2003/0179221 A1* 9/2003 Nitta ..... G09G 3/3406 345/690
2005/0168491 A1* 8/2005 Takahara ..... G09G 3/3241 345/690
(Continued)

FOREIGN PATENT DOCUMENTS

CN 101527124 A 9/2009
CN 106981272 A 7/2017
(Continued)

*Primary Examiner* — Ariel A Balaoing
(74) *Attorney, Agent, or Firm* — Banner & Witcoff, Ltd.

(57) ABSTRACT

A current compensation circuit, a virtual reality device and a control method are disclosed. The current compensation circuit includes: a first constant current sub-circuit, configured to generate a driving current of a backlight module; a second constant current sub-circuit, configured to generate a compensation current of the backlight module; a compensation gating sub-circuit, configured to determine whether to select the second constant current sub-circuit to supply power to the backlight module; and a black insertion control signal generation sub-circuit, configured to generate a black insertion control signal, connected with the first constant
(Continued)

current sub-circuit and the compensation gating sub-circuit, and configured to control, by the black insertion control signal, the first constant current sub-circuit and the second constant current sub-circuit to simultaneously supply power to or power off the backlight module, so that the black light module realizes a backlight black insertion.

20 Claims, 8 Drawing Sheets

(51) Int. Cl.
*H05B 45/37* (2020.01)
*H05B 45/20* (2020.01)

(52) U.S. Cl.
CPC ... *G09G 2310/063* (2013.01); *G09G 2320/02* (2013.01); *G09G 2330/02* (2013.01)

(56) References Cited

U.S. PATENT DOCUMENTS

2005/0231127 A1* 10/2005 Yamamoto ..... H05B 45/50 315/224
2007/0091057 A1* 4/2007 Lee ..... G09G 3/3413 345/102
2008/0239158 A1 10/2008 Wu et al.
2008/0284719 A1* 11/2008 Yoshida ..... G02F 1/13392 345/102
2010/0117551 A1* 5/2010 Lim ..... G09G 3/3406 315/254
2011/0109537 A1* 5/2011 Uguen ..... G09G 3/3406 345/102
2012/0139968 A1* 6/2012 Adachi ..... H05B 45/24 345/690
2014/0049730 A1* 2/2014 Lu ..... H02J 1/00 349/69
2016/0078830 A1* 3/2016 Huang ..... G09G 3/3406 345/691
2018/0082642 A1* 3/2018 Yamanaka ..... G09G 3/3291
2019/0051246 A1* 2/2019 Kim ..... G09G 3/3266
2020/0058257 A1 2/2020 Pan et al.

FOREIGN PATENT DOCUMENTS

CN 108470546 A 8/2018
JP 2010256689 A 11/2010

* cited by examiner

CURRENT COMPENSATION CIRCUIT, VIRTUAL REALITY DEVICE AND CONTROL METHOD

This application is a U.S. National Phase Entry of International Application No. PCT/CN2019/081478 filed on Apr. 4, 2019, designating the United States of America and claiming priority to Chinese patent application No. 201810318225.X, filed on Apr. 8, 2018. The present application claims priority to and the benefit of the above-identified applications are incorporated by reference herein in their entirety.

TECHNICAL FIELD

Embodiments of the present disclosure relate to a current compensation circuit, a virtual reality device and a control method.

BACKGROUND

Virtual reality (VR) systems are usually used in fields such as games and video play, etc., where scenarios are switched frequently. In order to improve video fluency, refresh frequency of display is usually required to be greater than 90 HZ. Because a liquid crystal response takes several milliseconds, when scenarios are switched at a high rate, a motion blur phenomenon caused by untimely liquid crystal response may occur, which seriously affects user experience of the VR systems.

SUMMARY

At least one embodiment of the present disclosure provides a current compensation circuit, including: a first constant current sub-circuit, configured to generate a driving current of a backlight module; a second constant current sub-circuit, configured to generate a compensation current of the backlight module; a compensation gating sub-circuit, connected with the second constant current sub-circuit, and configured to determine whether to select the second constant current sub-circuit to supply power to the backlight module; and a black insertion control signal generation sub-circuit, configured to generate a black insertion control signal, connected with the first constant current sub-circuit and the compensation gating sub-circuit, and configured to control, by the black insertion control signal, the first constant current sub-circuit and the second constant current sub-circuit to simultaneously supply power to or power off the backlight module, so that the blacklight module realizes a backlight black insertion.

For example, in the current compensation circuit provided by an embodiment of the present disclosure, the first constant current sub-circuit includes a first constant current boosting chip, a first energy storage inductor, and a voltage regulating resistor, the first energy storage inductor is connected between a power input terminal of the first constant current boosting chip and a switch output terminal of the first constant current boosting chip, a regulating terminal of the first constant current boosting chip is grounded through the voltage regulating resistor, an output control terminal of the first constant current boosting chip is configured to receive the black insertion control signal, the switch output terminal of the first constant current boosting chip is connected with a first electrode of the backlight module, and a negative electrode output terminal of the first constant current boosting chip is connected with a second electrode of the backlight module.

For example, in the current compensation circuit provided by an embodiment of the present disclosure, the first constant current sub-circuit further includes a first energy storage capacitor, and an electrical connection point between the switch output terminal of the first constant current boosting chip and the first electrode of the backlight module is grounded through the first energy storage capacitor.

For example, in the current compensation circuit provided by an embodiment of the present disclosure, the first constant current sub-circuit further includes a first diode which is configured to prevent flowing back of electric current, a positive electrode of the first diode is connected with the switch output terminal of the first constant current boosting chip, and an electrical connection point between a negative electrode of the first diode and the first electrode of the backlight module is grounded through the first energy storage capacitor.

For example, in the current compensation circuit provided by an embodiment of the present disclosure, the second constant current sub-circuit includes a second constant boosting chip, and a second energy storage inductor, the second energy storage inductor is connected between a power input terminal of the second constant current boosting chip and a switch output terminal of the second constant current boosting chip, a boosting switch terminal of the second constant current boosting chip is configured to receive the black insertion control signal through an inverter, a switch output terminal of the second constant current boosting chip is connected with the first electrode of the backlight module, and a negative electrode output terminal of the second constant current boosting chip and the second electrode of the backlight module are connected with the compensation gating sub-circuit.

For example, in the current compensation circuit provided by an embodiment of the present disclosure, the second constant current sub-circuit further includes a second energy storage capacitor, and an electrical connection point between the switch output terminal of the second constant current boosting chip and the first electrode of the backlight module is grounded through the second energy storage capacitor.

For example, in the current compensation circuit provided by an embodiment of the present disclosure, the second constant current sub-circuit further includes a second diode which is configured to prevent flowing back of electric current, a positive electrode of the second diode is connected with the switch output terminal of the second constant current boosting chip, and a negative electrode of the second diode is grounded through the second energy storage capacitor.

For example, the current compensation circuit provided by an embodiment of the present disclosure further includes a third diode which is configured to prevent flowing back of electric current, a negative electrode of the third diode is connected with the first electrode of the backlight module, and a positive electrode of the third diode is grounded through the second energy storage capacitor.

For example, in the current compensation circuit provided by an embodiment of the present disclosure, the compensation gating sub-circuit includes a first switching transistor, a second switching transistor, a third switching transistor and a fourth switching transistor, a first operational amplifier, a second operational amplifier, a first resistor and a second resistor, a drain electrode of the first switching transistor is connected with a drain electrode of the second switching transistor, a gate electrode of the second switching transistor is connected with the drain electrode of the second switching transistor, a source electrode of the second switching transistor is configured to receive a reference voltage, an electrical connection point between a source electrode of the first switching transistor and an inverting input terminal of the first operational amplifier is grounded through the first resistor, a non-inverting input terminal of the first operational amplifier is configured to receive the black insertion control signal, an output terminal of the first operational amplifier is connected with a gate electrode of the first switching transistor; the gate electrode of the second switching transistor is connected with a gate electrode of the fourth switching transistor, a source electrode of the fourth switching transistor is configured to receive the reference voltage, a drain electrode of the fourth switching transistor is connected with an enable terminal of the second operational amplifier, a non-inverting input terminal of the second operational amplifier is configured to receive the black insertion control signal, an electrical connection point between an inverting input terminal of the second operational amplifier and a source electrode of the third switching transistor is grounded through the second resistor, an output terminal of the second operational amplifier is connected with a gate electrode of the third switching transistor, and a drain electrode of the third switching transistor is connected with the negative electrode output terminal of the second constant current boosting chip.

For example, in the current compensation circuit provided by an embodiment of the present disclosure, the first switching transistor and the third switching transistor are N-typed transistors, and the second switching transistor and the fourth switching transistor are P-typed transistor.

At least one embodiment of the present disclosure further provides virtual reality device, including a liquid crystal display panel, and the current compensation circuit provided by any one of the embodiments of the present disclosure, and the liquid crystal display panel includes a backlight module.

At least one embodiment of the present disclosure further provides a control method of a current compensation circuit, including: in a case where a black insertion control signal is at a first electrical level, controlling a first constant current sub-circuit to supply power to a backlight module, and simultaneously controlling a second constant current sub-circuit to supplementally supply power to the backlight module; and in a case where the black insertion control signal is at a second electrical level different from the first electrical level, controlling the first constant current sub-circuit to stop supplying power to the backlight module, and simultaneously controlling the second constant current sub-circuit to stop supplementally supplying power to the backlight module, so that the backlight module realizes a backlight black insertion.

For example, in the control method of the current compensation circuit provided by an embodiment of the present disclosure, the controlling the second constant current sub-circuit to stop supplementally supplying power to the backlight module includes: in a case where the black insertion control signal is at the second electrical level, controlling the second constant current sub-circuit to charge a second energy storage capacitor; and in a case where the black insertion control signal is at the second electrical level, cutting off a loop where an electrical energy of the second energy storage capacitor flows to the backlight module through a compensation gating sub-circuit.

For example, in the control method of the current compensation circuit provided by an embodiment of the present disclosure, the controlling the second constant current sub-circuit to supplementally supply power to the backlight module includes: in a case where the black insertion control signal is at the first electrical level, controlling the second constant current sub-circuit to stop charging a second energy storage capacitor; in a case where the black insertion control signal is at the first electrical level, connecting a loop where an electrical energy of the second energy storage capacitor flows to the backlight module through a compensation gating sub-circuit so that the second energy storage capacitor delivers an electrical energy to the backlight module.

At least one embodiment of the present disclosure further provides a current compensation circuit, including a first constant current sub-circuit, a second constant current sub-circuit, an energy storage sub-circuit and a compensation gating sub-circuit. The first constant current sub-circuit is configured to receive a black insertion control signal, and to provide a driving current to a backlight module in a case where the black insertion control signal is at a first electrical level; the second constant current sub-circuit is connected with the energy storage sub-circuit, and configured to receive the black insertion control signal, and the second constant current sub-circuit is configured to charge the energy storage sub-circuit in a case where the black insertion control signal is at a second electrical level different from the first electrical level; and the compensation gating sub-circuit is connected with the energy storage sub-circuit and the backlight module, and configured to receive the black insertion control signal, and the compensation gating sub-circuit is configured to make the energy storage sub-circuit discharge to the backlight module to provide a compensation current in a case where the black insertion control signal is at the first electrical level, and the compensation gating sub-circuit is configured to electrically disconnect the energy storage sub-circuit from the backlight module in a case where the black insertion control signal is at the second electrical level.

For example, the current compensation circuit provided by an embodiment of the present disclosure further includes a black insertion control signal generation sub-circuit, and the black insertion control signal generation sub-circuit is configured to generate a black insertion control signal.

For example, in the current compensation circuit provided by an embodiment of the present disclosure, the first constant current sub-circuit includes a first constant current boosting chip, a first energy storage inductor, and a voltage regulating resistor, the first energy storage inductor is connected between a power input terminal of the first constant current boosting chip and a switch output terminal of the first constant current boosting chip, a regulating terminal of the first constant current boosting chip is grounded through the voltage regulating resistor, an output control terminal of the first constant current boosting chip is configured to receive the black insertion control signal, the switch output terminal of the first constant current boosting chip is connected with a first electrode of the backlight module, and a negative electrode output terminal of the first constant current boosting chip is connected with a second electrode of the backlight module.

For example, in the current compensation circuit provided by an embodiment of the present disclosure, the second constant current sub-circuit includes a second constant boosting chip, a second energy storage inductor and an inverter the second energy storage inductor is connected between a power input terminal of the second constant current boosting chip and a switch output terminal of the second constant current boosting chip, a boosting switch terminal of the second constant current boosting chip is connected with a second terminal of the inverter, a first terminal of the inverter is configured to receive the black insertion control signal, the switch output terminal of the second constant current boosting chip is connected with a first electrode of the backlight module, and a negative electrode output terminal of the second constant current boosting chip is connected with a second electrode of the backlight module.

For example, in the current compensation circuit provided by an embodiment of the present disclosure, the energy storage sub-circuit includes a second energy storage capacitor, a first electrode of the second energy storage capacitor is connected with the switch output terminal of the second constant current boosting chip, and a second electrode of the second energy storage capacitor is grounded.

For example, in the current compensation circuit provided by an embodiment of the present disclosure, the compensation gating sub-circuit includes a fifth switching transistor, a gate electrode of the fifth switching transistor is configured to receive the black insertion control signal, a first electrode of the fifth switching transistor is connected with the first electrode of the second energy storage capacitor, and a second electrode of the fifth switching transistor is grounded.

At least one embodiment of the present disclosure further provides a control method of the current compensation circuit provided by any one of the embodiments of the present disclosure, including: providing a black insertion control signal at the second electrical level, so that the second constant current sub-circuit charges the energy storage sub-circuit, and the energy storage sub-circuit is electrically disconnected from the backlight module; and providing a black insertion control signal at the first electrical level, so that the first constant current sub-circuit provides the driving current to the backlight module, and the energy storage sub-circuit discharges to the backlight module to provide the compensation current.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
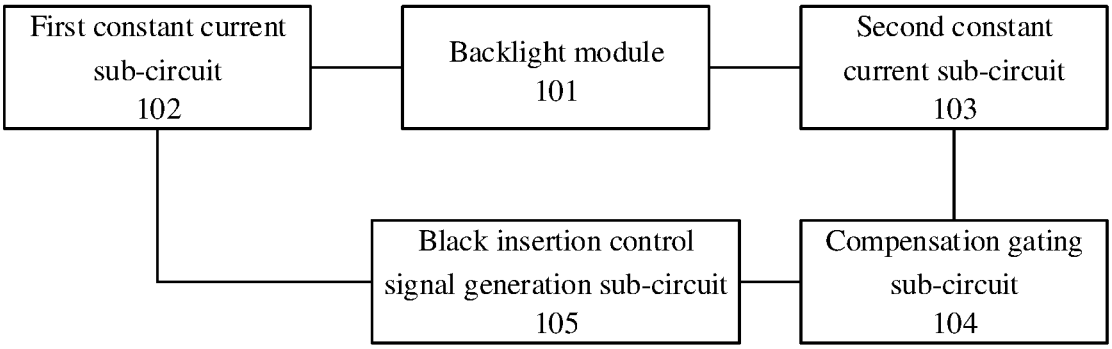
FIG. 1 is a schematic diagram of a current compensation circuit provided by at least one embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

To solve a motion blur problem of a liquid crystal display, a backlight black insertion method may be adopted, that is, turning off the backlight module when the liquid crystal responds, and turning on the backlight module when the liquid crystal response ends. When the liquid crystal rotates, the backlight module is in an off state, and the backlight module is turned on when rotation of the liquid crystal is completed. That is to say, when the liquid crystal is rotating, a display operation is not performed, and the display operation is performed only after the rotation of the liquid crystal is completed, thus avoiding the motion blur problem of the liquid crystal display. Because the liquid crystal charging takes a certain time, an on time of the backlight module is usually short, for example, a ratio of the on time and an off time of the backlight module is 1:9.

In implementation of a backlight black insertion method for a general virtual reality (VR) device, due to a short on time of the backlight module, a conversion rate of light energy is low. Moreover, in order to meet the user's higher demand for space experience, the VR device usually integrates various sensors such as a space locator or a gyroscope, etc. These sensors have long transmission lines, which may cause input power to be unstable, and further affect user experience.

FIG. 1 is a schematic diagram of a current compensation circuit provided by at least one embodiment of the present disclosure. As shown in FIG. 1, a current compensation circuit includes a first constant current sub-circuit 102, a second constant current sub-circuit 103, a compensation gating sub-circuit 104 and a black insertion control signal generation sub-circuit 105.

For example, the first constant current sub-circuit 102 is connected with a backlight module 101, and is configured to generate a driving current of the backlight module 101.

For example, the second constant current sub-circuit 103 is connected with the backlight module 101, and is configured to generate a compensation current of the backlight module 101.

For example, the compensation gating sub-circuit 104 is connected with the second constant current sub-circuit 103, and is configured to determine whether to select the second constant current sub-circuit 103 to supply power to the backlight module 101.

For example, the black insertion control signal generation sub-circuit 105 is configured to generate a black insertion control signal. The black insertion control signal generation sub-circuit 105 is connected with the first constant current sub-circuit 102 and the compensation gating sub- circuit 104, and is configured to control, by the black insertion control signal, the first constant current sub-circuit and the second constant current sub-circuit to simultaneously supply power to or power off the backlight module, so that the backlight module 101 realizes a backlight black insertion.

When the backlight black insertion is performed on the backlight module, the driving current for the backlight module is instantaneously pulled to a higher level. In this case, because a line resistance of the VR device is large, the input power may be unstable. During the time period when the backlight module is turned off, through energy storage of the second constant current cub-circuit 103, compensation of pulling up the driving current is implemented, thereby stabilizing power supply.

Figure 2:
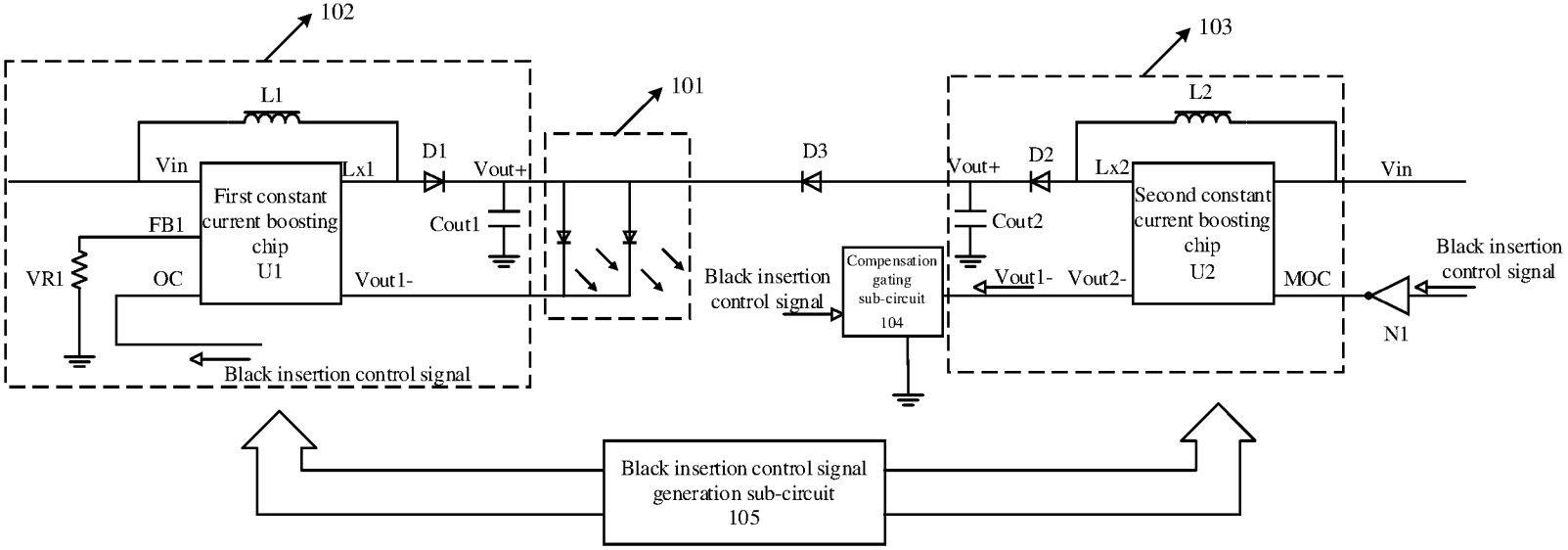
FIG. 2 is an exemplary circuit diagram of a current compensation circuit provided by at least one embodiment of the present disclosure.

FIG. 2 is an exemplary circuit diagram of a current compensation circuit provided by at least one embodiment of the present disclosure. As shown in FIG. 2, the first constant current sub-circuit 102 includes a first constant current boosting chip U1, a first energy storage inductor L1, and a voltage regulating resistor VR1. The first energy storage inductor L1 is connected between a power input terminal Vin of the first constant current boosting chip U1 and a switch output terminal Lx1 of the first constant current boosting chip U1. A regulating terminal FB1 of the first constant current boosting chip U1 is grounded through the voltage regulating resistor VR1. An output control terminal OC of the first constant current boosting chip U1 is configured to receive the black insertion control signal. The switch output terminal Lx1 of the first constant current boosting chip U1 is connected with a first electrode (for example, a positive electrode) of the backlight module 101, and a negative electrode output terminal Vout1− of the first constant current boosting chip U1 is connected with a second electrode (for example, a negative electrode) of the backlight module 101.

In some embodiments, the first constant current sub-circuit 102 further includes a first energy storage capacitor Cout1, and an electrical connection point between the switch output terminal Lx1 of the first constant current boosting chip U1 and the first electrode (for example, the positive electrode) of the backlight module 101 is grounded through the first energy storage capacitor Cout1.

In some embodiments, the first constant current sub-circuit 102 further includes a first diode D1 which is configured to prevent flowing back of electric current. A positive electrode of the first diode D1 is connected with the switch output terminal Lx1 of the first constant current boosting chip U1, and an electrical connection point between a negative electrode of the first diode D1 and the first electrode (for example, the positive electrode) of the backlight module 101 is grounded through the first energy storage capacitor Cout1.

For example, the first constant current boosting chip U1 can be an integrated chip including a switching power supply boost circuit.

For example, as shown in FIG. 2, the second constant current cub-circuit 103 includes a second constant boosting chip U2, and a second energy storage inductor L2. The second energy storage inductor L2 is connected between a power input terminal Vin of the second constant current boosting chip U2 and a switch output terminal Lx2 of the second constant current boosting chip U2. A boosting switch terminal MOC of the second constant current boosting chip U2 is configured to receive the black insertion control signal through an inverter N1. A switch output terminal Lx2 of the second constant current boosting chip U2 is connected with the first electrode (for example, the positive electrode) of the backlight module 101, and a negative electrode output terminal Vout2− of the second constant current boosting chip U2 and the second electrode (for example, the negative electrode) of the backlight module 104 are connected with the compensation gating sub-circuit 104. The compensation gating sub-circuit 104 is configured to receive the black insertion control signal, and to control whether the second constant current cub-circuit 103 supplementally supply power to the backlight module 101 by the black insertion control signal.

In some embodiments, the second constant current sub-circuit 103 further includes a second energy storage capacitor Cout2, and an electrical connection point between the switch output terminal Lx2 of the second constant current boosting chip U2 and the first electrode (for example, the positive electrode) of the backlight module 101 is grounded through the second energy storage capacitor Cout2.

In some embodiments, the second constant current sub-circuit 103 further includes a second diode D2 which is configured to prevent flowing back of electric current. A positive electrode of the second diode D2 is connected with the switch output terminal Lx2 of the second constant current boosting chip U2, and a negative electrode of the second diode D2 is grounded through the second energy storage capacitor Cout2.

In some embodiments, the current compensation circuit further includes a third diode D3 which is configured to prevent flowing back of electric current. A negative electrode of the third diode D3 is connected with the first electrode (for example, the positive electrode) of the backlight module 101, and a positive electrode of the third diode D3 is grounded through the second energy storage capacitor Cout2.

An operation principle of the current compensation circuit shown in FIG. 2 will be described below.

In a case where the back insertion control signal is at a first electrical level (for example, a high electrical level), the first constant current boosting chip U1 is boosted to an electrical level required by the backlight module 101 which generally ranges from ten-odd volts to several tens of volts, depending on a load. Simultaneously, the compensation gating sub-circuit 104 selects the second constant current cub-circuit 103 to supplementally supply power to the backlight module 101, and in this case, the backlight module is illuminated. It should be noted that, in a case where the black insertion control signal is at the high electrical level, the second constant current boosting chip U2 is in a ceased operation state, and in this case, the second energy storage capacitor Cout2 supplementally supplies power to the backlight module 101.

In a case where the back insertion control signal is at a second electrical level (for example, a low electrical level), the switch output terminal Lx1 of the first constant current boosting chip U1 does not output current. Simultaneously, the compensation gating sub-circuit 104 does not select the second constant current cub-circuit 103 to supplementally supply power to the backlight module 101. Therefore, in this case, the backlight module is not illuminated. It should be noted that, in a case where the black insertion control signal is at the low electrical level, the second constant current boosting chip U2 operates to charge the second energy storage capacitor Cout2. For example, the black insertion control signal can be a pulse width modulation (PWM) signal.

In summary, the second constant current cub-circuit 103 supplementally supplying power to the backlight module 101 is implemented under control of the back insertion control signal.

Figure 3:
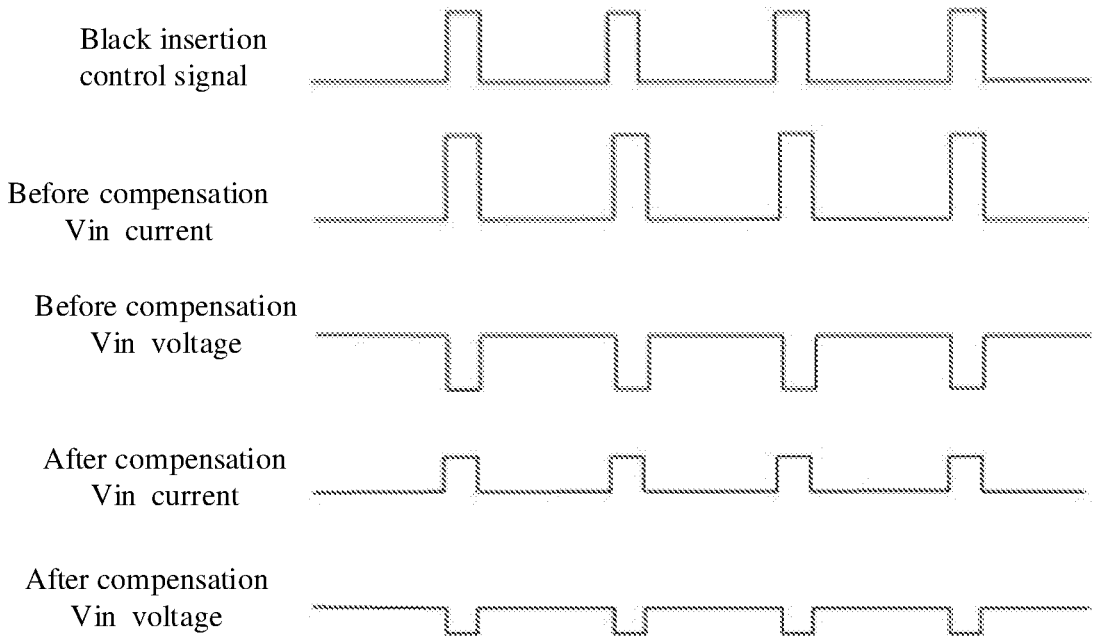
FIG. 3 is an exemplary waveform diagram of an input power source before and after compensation according to embodiments of the present disclosure.

FIG. 3 is an exemplary waveform diagram of an input power source before and after compensation according to embodiments of the present disclosure.

As shown in FIG. 3, before compensation, in a case where the black insertion control signal is at the high electrical level, magnitudes of voltage drop and current rise are very significant, thereby causing instability of an input power supply. After compensation, in a case where the black insertion control signal is at the high electrical level, the magnitudes of voltage drop and current rise are reduced, thereby reducing adverse effects on the input power supply, enhancing stability of the power supply, and reducing requirements for a power adapter.

Figure 4:
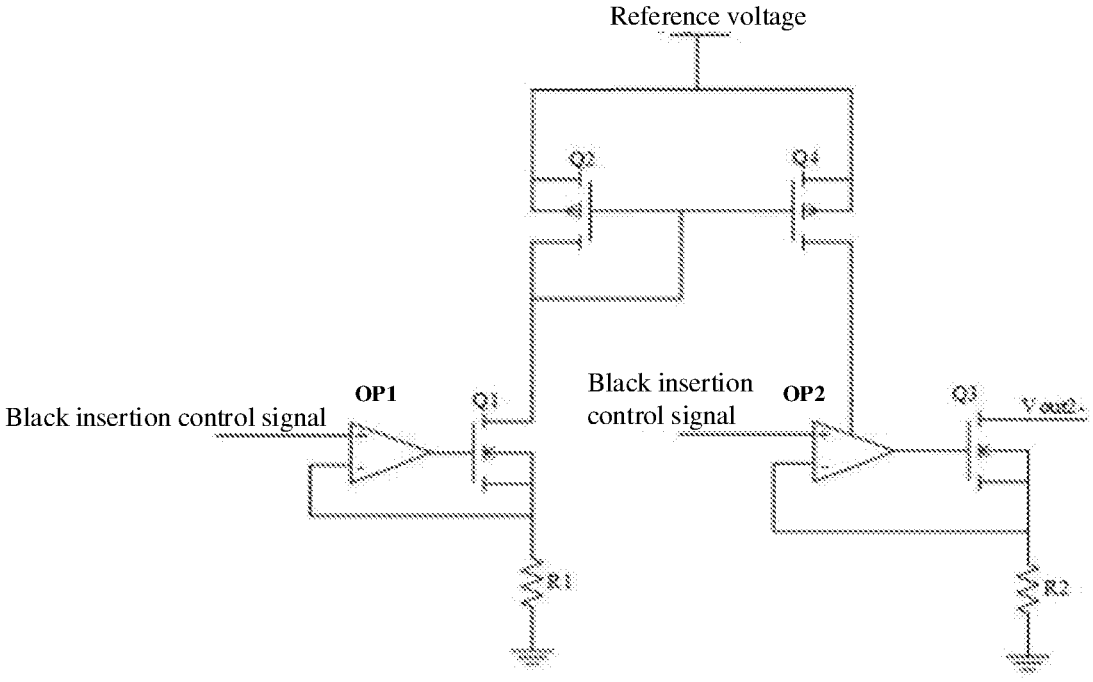
FIG. 4 is an exemplary circuit diagram of a compensation gating sub-circuit provided by at least one embodiment of the present disclosure.

FIG. 4 is an exemplary circuit diagram of a compensation gating sub-circuit provided by at least one embodiment of the present disclosure. As shown in FIG. 4, the compensation gating sub-circuit 104 includes a first switching transistor Q1, a second switching transistor Q2, a third switching transistor Q3 and a fourth switching transistor Q4, a first operational amplifier OP1, a second operational amplifier OP2, a first resistor R1 and a second resistor R2.

A drain electrode of the first switching transistor Q1 is connected with a drain electrode of the second switching transistor Q2. A gate electrode of the second switching transistor Q2 is connected with the drain electrode of the second switching transistor Q2. A source electrode of the second switching transistor Q2 is configured to receive a reference voltage. An electrical connection point between a source electrode of the first switching transistor Q1 and an inverting input terminal of the first operational amplifier OP1 is grounded through the first resistor R1. A non-inverting input terminal of the first operational amplifier OP1 is configured to receive the black insertion control signal, and an output terminal of the first operational amplifier OP1 is connected with a gate electrode of the first switching transistor Q1. The gate electrode of the second switching transistor Q2 is connected with a gate electrode of the fourth switching transistor Q4. A source electrode of the fourth switching transistor Q4 is configured to receive the reference voltage. A drain electrode of the fourth switching transistor Q4 is connected with an enable terminal of the second operational amplifier OP2. A non-inverting input terminal of the second operational amplifier OP2 is configured to receive the black insertion control signal. An electrical connection point between an inverting input terminal of the second operational amplifier OP2 and a source electrode of the third switching transistor Q3 is grounded through the second resistor. An output terminal of the second operational amplifier OP2 is connected with a gate electrode of the third switching transistor Q3, and a drain electrode of the third switching transistor Q3 is connected with the negative electrode output terminal Vout2– of the second constant current boosting chip U2.

For example, in some embodiments, the first switching transistor Q1 and the third switching transistor Q3 are N-typed transistors (for example, thin film transistors, field effect transistors or other switching devices having the same characteristics), and the second switching transistor and the fourth switching transistor are P-typed transistors (for example, thin film transistors, field effect transistors or other switching devices having the same characteristics).

The operation principle of the compensation gating sub-circuit 104 will be described below.

In a case where the black insertion control signal is at a first electrical level (for example, a high electrical level), the first switching transistor Q1, the second switching transistor Q2, the third switching transistor Q3 and the fourth switching transistor Q4 are all turned on. In this case, a conduction current of the third switching transistor Q3 is the same as a conduction current of the first switching transistor Q4, and is connected with a loop where the electrical energy of the second energy storage capacitor Cout2 flows to the backlight module 101. In this case, the second energy storage capacitor Cout2 is discharged to achieve the compensation of the electrical energy.

In a case where the black insertion control signal is at a second electrical level (for example, a low electrical level), the first switching transistor Q1, the second switching transistor Q2, the third switching transistor Q3 and the fourth switching transistor Q4 are all turned off. In this case, because no conduction current is on the third switching transistor Q3, the loop where the electrical energy of the second energy storage capacitor Cout2 flows to the backlight module 101 is cut off. In this case, the second energy storage capacitor Cout2 stops discharging, and no longer compensates for the electrical energy to the backlight module 101.

Figure 5:
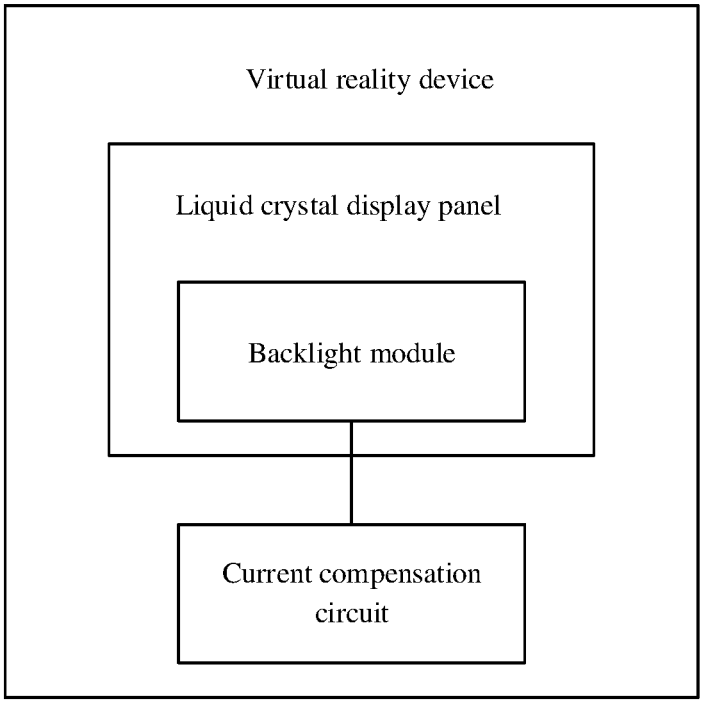
FIG. 5 is a schematic diagram of a virtual reality device provided by at least one embodiment of the present disclosure.

At least one embodiment of the present disclosure further provides a virtual reality device. As shown in FIG. 5, the virtual reality device includes a liquid crystal display panel and any one of the current compensation circuits provided by the embodiments of the present disclosure. For example, the liquid crystal display panel includes a backlight module, and the current compensation circuit is connected with the backlight module.

Figure 6:
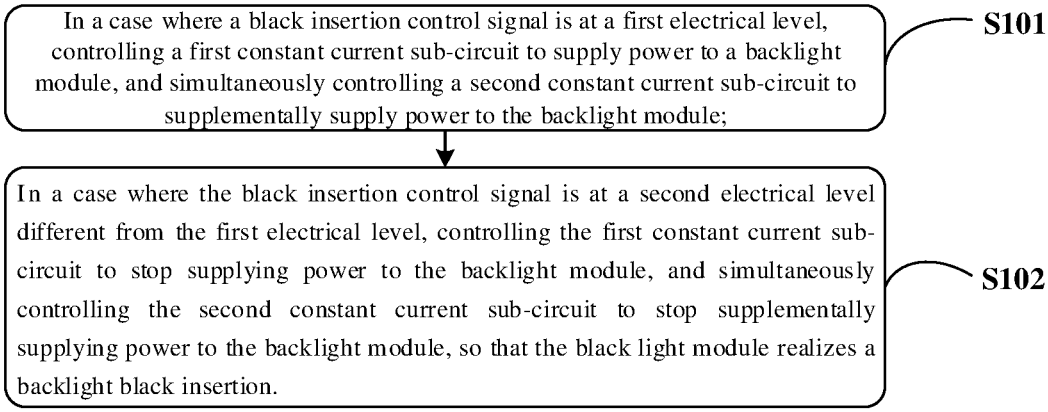
FIG. 6 is an exemplary flowchart of a control method of a current compensation circuit provided by at least one embodiment of the present disclosure.

Some embodiments of the present disclosure further provide a control method of a current compensation circuit. As shown in FIG. 6, the control method includes the following operational steps.

Step S101: in a case where a black insertion control signal is at a first electrical level (for example, a high electrical level), controlling a first constant current sub-circuit to supply power to a backlight module, and simultaneously controlling a second constant current sub-circuit to supplementally supply power to the backlight module.

Step S102: in a case where the black insertion control signal is at a second electrical level (for example, a low electrical level) different from the first electrical level, controlling the first constant current sub-circuit to stop supplying power to the backlight module, and simultaneously controlling the second constant current sub-circuit to stop supplementally supplying power to the backlight module, so that the backlight module realizes a backlight black insertion.

Figure 7:
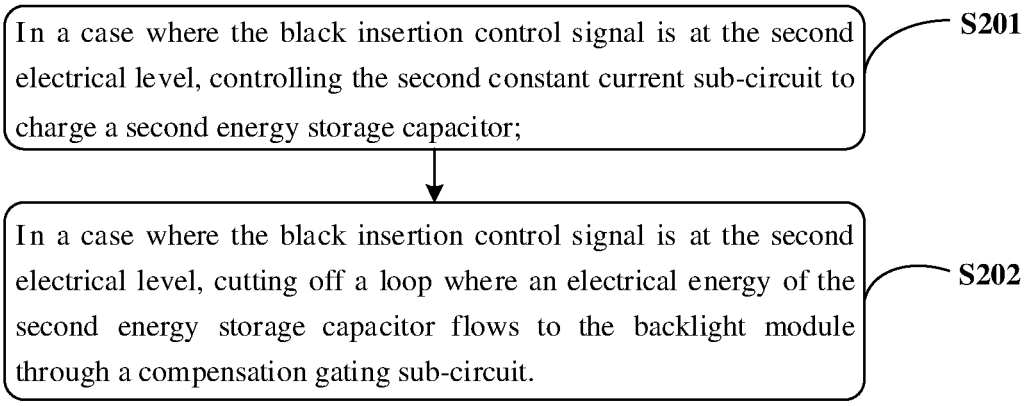
FIG. 7 is an exemplary flowchart of step 102 in FIG. 6.

For example, in some embodiments, as shown in FIG. 7, step S102 mentioned above can include the following operational steps.

Step S201: in a case where the black insertion control signal is at the second electrical level (for example, the low electrical level), controlling the second constant current sub-circuit is controlled to charge a second energy storage capacitor;

Step S202: in a case where the black insertion control signal is at the second electrical level (for example, the low electrical level), cutting off a loop where an electrical energy of the second energy storage capacitor flows to the backlight module through a compensation gating sub-circuit.

Figure 8:
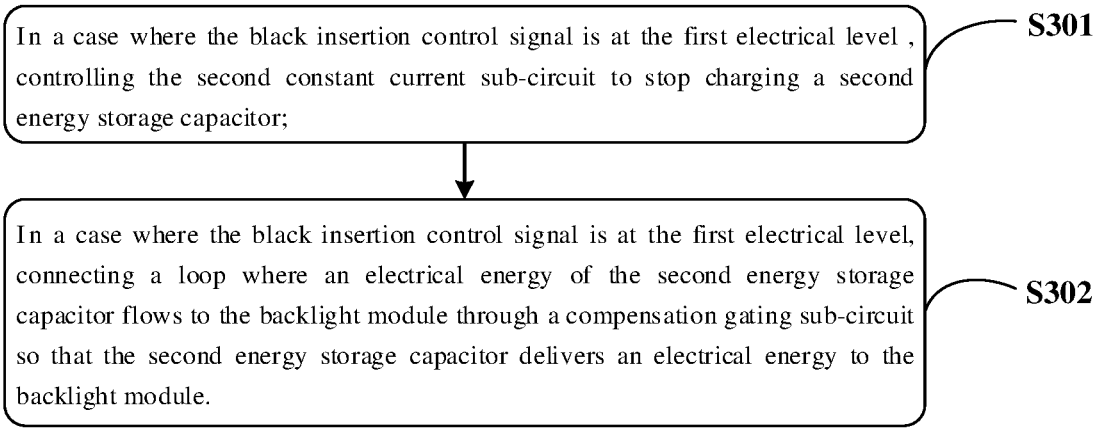
FIG. 8 is an exemplary flowchart of step 101 in FIG. 6.

For example, in some embodiments, as shown in FIG. 8, step S101 mentioned above can include the following operational steps.

Step S301: in a case where the black insertion control signal is at the first electrical level (for example, the high electrical level), controlling the second constant current sub-circuit to stop charging a second energy storage capacitor.

Step S302: in a case where the black insertion control signal is at the first electrical level (for example, the high electrical level), connecting a loop where an electrical energy of the second energy storage capacitor flows to the backlight module through a compensation gating sub-circuit, so that the second energy storage capacitor delivers an electrical energy to the backlight module.

It should be noted that, in the embodiments of the present disclosure, a negative electrode of the backlight module can be in a floating state.

Figure 9:
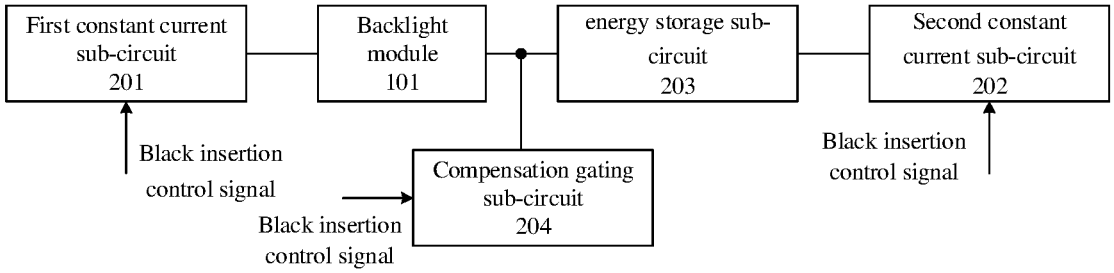
FIG. 9 is a schematic diagram of another current compensation circuit provided by at least one embodiment of the present disclosure.

At least one embodiment of the present disclosure provides a current compensation circuit. As shown in FIG. 9, the current compensation circuit includes a first constant current sub-circuit 201, a second constant current sub-circuit 202, an energy storage sub-circuit 203 and a compensation gating sub-circuit 204.

For example, the first constant current sub-circuit 201 is configured to receive a black insertion control signal, and to provide a driving current to a backlight module 101 in a case where the black insertion control signal is at a first electrical level (for example, a high electrical level).

For example, the second constant current sub-circuit 202 is connected with the energy storage sub-circuit 203, and configured to receive the black insertion control signal, and the second constant current sub-circuit 202 is configured to charge the energy storage sub-circuit 203 in a case where the black insertion control signal is at a second electrical level (for example, a low electrical level).

For example, the compensation gating sub-circuit 204 is connected with the energy storage sub-circuit 203 and the backlight module 101, and configured to receive the black insertion control signal, and the compensation gating sub-circuit 203 is configured to make the energy storage sub-circuit 203 discharge to the backlight module 101 to provide a compensation current in a case where the black insertion control signal is at the first electrical level (for example, the high electrical level), and the compensation gating sub-circuit 204 is configured to electrically disconnect the energy storage sub-circuit 203 from the backlight module 101 in a case where the black insertion control signal is at the second electrical level (for example, the low electrical level).

It should be noted that, in the embodiments of the present disclosure, the black insertion control signal may be, for example, a pulse width modulation (PWM) signal. The pulse width modulation signal has a high electrical level and a low electrical level. In the embodiments of the present disclosure, in order to distinguish the high electrical level and the low electrical level, the high electrical level is referred to as a first electrical level, while the low electrical level is referred to as a second electrical level, and the present disclosure includes this case but is not limited thereto. In some other circuits, the first electrical level may also be a low electrical level while the second electrical level may be a high electrical level.

The current compensation circuit provided by the embodiments of the present disclosure can be applied to the backlight module 101, so as to perform current compensation on the backlight module 101. For example, in a case where the backlight module 101 implements the above backlight black insertion method, when the backlight module 101 is not required to be illuminated, that is, when the black insertion control signal is provide as a second electrical level (for example, a low electrical level), the energy storage sub-circuit 203 can be charged by the second constant current sub-circuit 202, so as to store the electrical energy in the energy storage sub-circuit 203. Then, when the backlight module 101 is required to be illuminated, that is, when the black insertion control signal is provide as a first electrical level (for example, a high electrical level), a driving current is provided to the backlight module 101 by the first constant current sub-circuit 201 while the compensation gating sub-circuit 203 controls such that the energy storage sub-circuit 203 discharges to the backlight module 101 to provide a compensation current.

In a case where the backlight module 101 is driven by the current compensation circuit, the electrical energy is first stored in the energy storage sub-circuit 203 during the time period when the backlight module 101 is not required to be illuminated. When the backlight module 101 is required to be illuminated, the energy storage sub-circuit 203 can further provide a compensation current to the backlight module 101, besides that the first constant current sub-circuit 201 can provide a driving current to the backlight module 101. Therefore, compared with driving the backlight module 101 by using the first constant current sub-circuit 201 alone, the voltage and the current of the input power supply required by the first constant current sub-circuit 201 can be reduced, thereby improving the stability of the input power supply, and further improving user experience of the virtual reality device employing the current compensation circuit.

Figure 10:
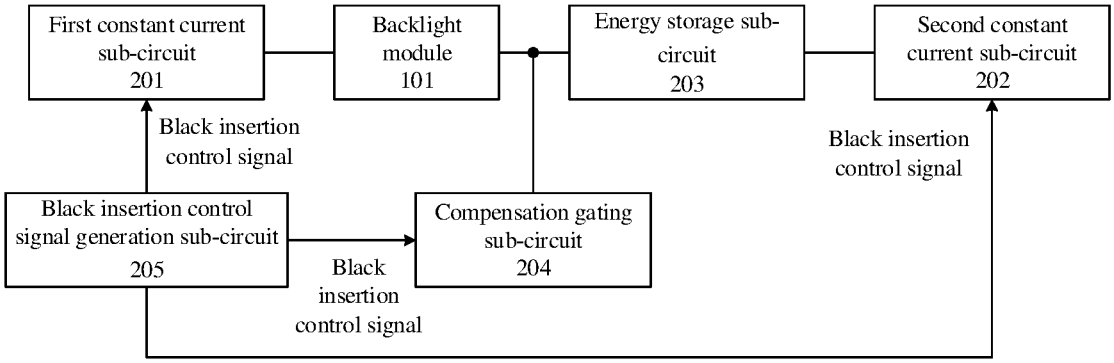
FIG. 10 is a schematic diagram of still another current compensation circuit provided by at least one embodiment of the present disclosure.

As shown in FIG. 10, the current compensation circuit provided by some embodiments of the present disclosure further includes a black insertion control signal generation sub-circuit 205. For example, the black insertion control signal generation sub-circuit 205 is configured to generate a black insertion control signal.

Figure 11:
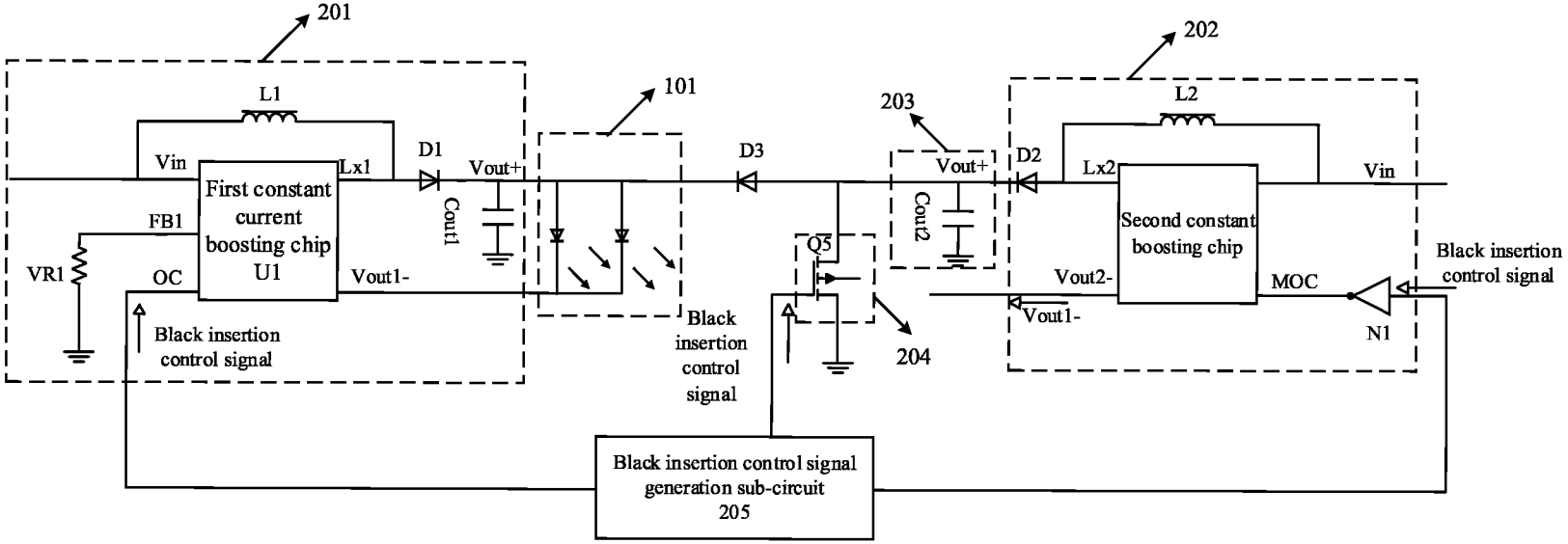
FIG. 11 is an exemplary circuit diagram of another current compensation circuit provided by at least one embodiment of the present disclosure.
Figure 12:
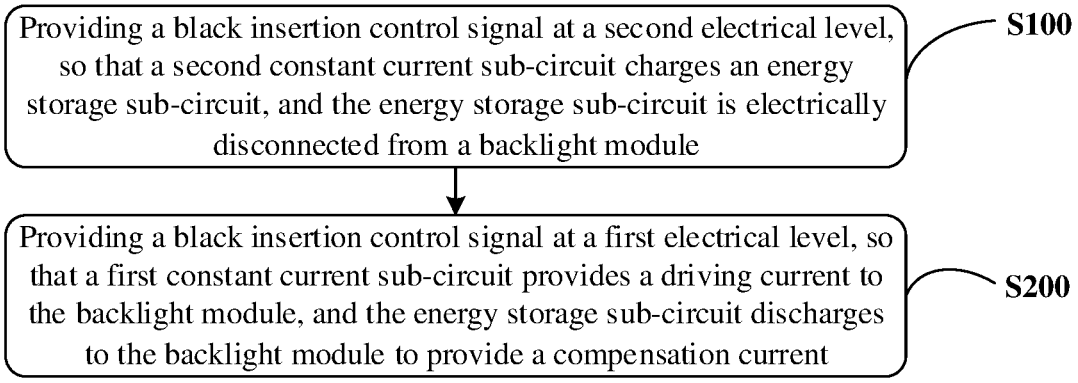
FIG. 12 is an exemplary flowchart of a control method of another current compensation circuit provided by at least one embodiment of the present disclosure.

As shown in FIG. 11, in the current compensation circuit provided by some embodiments of the present disclosure, the first constant current sub-circuit 201 includes a first constant current boosting chip U1, a first energy storage inductor L1 and a voltage regulating resistor VR1.

The first energy storage inductor L1 is connected between a power input terminal of the first constant current boosting chip U1 and a switch output terminal Lx1 of the first constant current boosting chip U1. A regulating terminal FB1 of the first constant current boosting chip U1 is grounded through the voltage regulating resistor VR1. An output control terminal OC of the first constant current boosting chip U1 is configured to receive the black insertion control signal. The switch output terminal Lx1 of the first constant current boosting chip U1 is connected with a first electrode (for example, a positive electrode) of the backlight module 101, and a negative electrode output terminal Vout1− of the first constant current boosting chip U1 is connected with a second electrode (for example, a negative electrode) of the backlight module 101.

It should be noted that, in the embodiments of the present disclosure, in order to distinguish two electrodes of the backlight module, one electrode of the two electrodes is referred to as a first electrode and the other electrode of the two electrodes is referred to as a second electrode. For example, the first electrode is a positive electrode and the second electrode is a negative electrode, and the present disclosure includes this case but is not limited thereto. For example, in some other circuits, the first electrode may r be a negative electrode and the second electrode may be a positive electrode depending on a change of the connection relationship.

For example, in some embodiments, as shown in FIG. 11, the first constant current sub-circuit 201 further includes a first energy storage capacitor Cout1, and an electrical connection point between the switch output terminal Lx1 of the first constant current boosting chip U1 and the first electrode (for example, the positive electrode) of the backlight module 101 is grounded through the first energy storage capacitor Cout1.

For example, in some embodiments, as shown in FIG. 11, the first constant current sub-circuit 201 further includes a first diode D1 which is configured to prevent flowing back of electric current, a positive electrode of the first diode D1 is connected with the switch output terminal Lx1 of the first constant current boosting chip U1, and an electrical connection point between a negative electrode of the first diode D1 and the first electrode (for example, the positive electrode) of the backlight module 101 is grounded through the first energy storage capacitor Cout1.

For example, the first constant current boosting chip U1 can be an integrated chip including a switching power supply boost circuit.

As shown in FIG. 11, the second constant current sub-circuit 202 includes a second constant boosting chip U2, a second energy storage inductor L2 and an inverter N1, For example, the second energy storage inductor L2 is connected between a power input terminal Vin of the second constant current boosting chip U2 and a switch output terminal Lx2 of the second constant current boosting chip U2. A boosting switch terminal MOC of the second constant current boosting chip U2 is connected with a second terminal of the inverter N1. A first terminal of the inverter N1 is configured to receive the black insertion control signal, the switch output terminal Lx2 of the second constant current boosting chip U1 is connected with a first electrode (for example, a positive electrode) of the backlight module 101, and a negative electrode output terminal Vout2− of the second constant current boosting chip U2 is connected with a second electrode (for example, a negative electrode) of the backlight module 101.

For example, the second constant current boosting chip U2 can be an integrated chip including a switching power supply boost circuit.

For example, as shown in FIG. 11, the energy storage sub-circuit 203 includes a second energy storage capacitor Cout2, a first electrode of the second energy storage capacitor Cout2 is connected with the switch output terminal Lx2 of the second constant current boosting chip U2, and a second electrode of the second energy storage capacitor Cout2 is grounded.

For example, in some embodiments, as shown in FIG. 11, the second constant current sub-circuit 202 further includes a second diode D2 which is configured to prevent flowing back of electric current. A positive electrode of the second diode D2 is connected with the switch output terminal Lx2 of the second constant current boosting chip U2, and a negative electrode of the second diode D2 is grounded through the second energy storage capacitor Cout2.

For example, in some embodiments, as shown in FIG. 11, the current compensation circuit further includes a third diode D3 which is configured to prevent flowing back of electric current. A negative electrode of the third diode D3 is connected with the first electrode (for example, the positive electrode) of the backlight module 101, and a positive electrode of the third diode D3 is grounded through the second energy storage capacitor Cout2.

For example, in some embodiments, as shown in FIG. 11, the compensation gating sub-circuit 204 includes a fifth switching transistor Q5, a gate electrode of the fifth switching transistor Q5 is configured to receive the black insertion control signal, a first electrode (for example, a source electrode) of the fifth switching transistor Q5 is connected with the first electrode of the second energy storage capacitor Cout2, and a second electrode of the fifth switching transistor Q5 is grounded.

For example, in some embodiments, the fifth switching transistor Q5 is a P-typed transistor (for example, a thin film transistor, a field effect transistor or other switching device having the same characteristics).

An operation principle of the current compensation circuit shown in FIG. 11 will be described below.

In a case where the back insertion control signal generated by the black insertion control signal generation sub-circuit 205 is at a first electrical level (for example, a high electrical level), the first constant current boosting chip U1 is boosted to an electrical level required by the backlight module 101 which generally ranges from ten-odd volts to several tens of volts, depending on a load. Simultaneously, the fifth switching transistor Q5 is turned off, that is, the compensation gating sub-circuit 204 causes the energy storage sub-circuit 203 (the second energy storage capacitor Cout2) to discharge to the backlight module 101 so as to provide a compensation current. Therefore, in a case where the black insertion control signal is at the first electrical level (for example, the high electrical level), the backlight module 101 is illuminated under a common driving of the driving current provided by the first constant current sub-circuit 201 and the compensation current provided by the energy storage sub-circuit 203.

In addition, it should be noted that, in a case where the black insertion control signal is at the high electrical level, the black insertion control signal is turned to at a low electrical level after passing through the inverter N1, and then is provided to the second constant current boosting chip U2. Therefore, in this case, the second constant current boosting chip U2 is in a ceased operation state.

In a case where the black insertion control signal is at a second electrical level (for example, a low electrical level), the switch output terminal Lx1 of the first constant current boosting chip U1 does not output the driving current.

Simultaneously, the fifth switching transistor Q5 is turned on, that is, the compensation gating sub-circuit 204 causes the energy storage sub-circuit 203 to be disconnected with the backlight module 10. Therefore, In a case where the black insertion control signal is at the second electrical level (for example, the low electrical level), the first constant current sub-circuit 201 and the energy storage sub-circuit 203 no longer provide the electrical energy to the backlight module 101. Therefore, the backlight module 101 is not illuminated.

In addition, in a case the black insertion control signal is at the lower electrical level, the black insertion control signal is turned to at the high electrical level after passing through the inverter N1, and then is provided to the second constant current boosting chip U2. Therefore, in this case, the second constant current boosting chip U2 is in an operation state to charge the second energy storage capacitor Cout2.

FIG. 3 is an exemplary waveform diagram of an input power source before and after compensation according to embodiments of the present disclosure.

As shown in FIG. 3, before compensation, in a case where the black insertion control signal is at the high electrical level, magnitudes of voltage drop and current rise are very significant, thereby causing instability of an input power supply. After compensation, in a case where the black insertion control signal is at the high electrical level, the magnitudes of voltage drop and current rise are reduced, thereby reducing adverse effects on the input power supply, enhancing stability of the power supply, and reducing requirements for a power adapter.

At least one embodiment of the present disclosure further provides a virtual reality device. The virtual reality device includes a liquid crystal display panel and any one of the current compensation circuits shown in FIG. 9 to FIG. 11. The liquid crystal display panel includes a backlight module.

At least one embodiment of the present disclosure further provides a control method. For example, the control method can be used to control any one of the current compensation circuits shown in FIG. 9 to FIG. 11, and the control method includes the following operational steps.

Step S100: providing a black insertion control signal at a second electrical level (for example, a low electrical level), so that the second constant current sub-circuit 202 charges the energy storage sub-circuit 203, and the energy storage sub-circuit 203 is electrically disconnected from the backlight module 101.

Step S200: providing a black insertion control signal at a first electrical level (for example, a high electrical level), so that the first constant current sub-circuit 201 provides a driving current to the backlight module 101, and the energy storage sub-circuit 203 discharges to the backlight module 101 to provide a compensation current.

It should be noted that, for a detailed description of the control method and technical effects, reference may be made to the corresponding description in the above embodiments of the current compensation circuit, and details are not described herein again.

What have been described above is related to specific embodiments of the present disclosure only, but the protection scope of the present disclosure is not limited thereto. The protection scope of the present disclosure should be subject to the protection scope defined by the claims.

What is claimed is:

1. A current compensation circuit, comprising:

a first constant current sub-circuit, configured to generate a driving current of a backlight module;

a second constant current sub-circuit, configured to generate a compensation current of the backlight module;

a compensation gating sub-circuit, connected with the second constant current sub-circuit, and configured to determine, according to a level of a black insertion control signal, whether to select the second constant current sub-circuit to supply power to the backlight module; and a black insertion control signal generation sub-circuit, configured to generate the black insertion control signal, connected with the first constant current sub-circuit and the compensation gating sub-circuit, and configured to control, by the black insertion control signal, the first constant current sub-circuit and the second constant current sub-circuit to simultaneously supply power to or power off the backlight module, so that the backlight module realizes a backlight black insertion.

2. The current compensation circuit according to claim 1, wherein the first constant current sub-circuit comprises a first constant current boosting chip, a first energy storage inductor, and a voltage regulating resistor, the first energy storage inductor is connected between a power input terminal of the first constant current boosting chip and a switch output terminal of the first constant current boosting chip, a regulating terminal of the first constant current boosting chip is grounded through the voltage regulating resistor, an output control terminal of the first constant current boosting chip is configured to receive the black insertion control signal, the switch output terminal of the first constant current boosting chip is connected with a first electrode of the backlight module, and a negative electrode output terminal of the first constant current boosting chip is connected with a second electrode of the backlight module.

3. The current compensation circuit according to claim 2, wherein the first constant current sub-circuit further comprises a first energy storage capacitor, and wherein an electrical connection point, between the switch output terminal of the first constant current boosting chip and the first electrode of the backlight module, is grounded through the first energy storage capacitor.

4. The current compensation circuit according to claim 3, wherein the first constant current sub-circuit further comprises a first diode which is configured to prevent flowing back of electric current, a positive electrode of the first diode is connected with the switch output terminal of the first constant current boosting chip, and an electrical connection point between a negative electrode of the first diode and the first electrode of the backlight module is grounded through the first energy storage capacitor.

5. The current compensation circuit according to claim 2, wherein the second constant current sub-circuit comprises a second constant current boosting chip, and a second energy storage inductor, the second energy storage inductor is connected between a power input terminal of the second constant current boosting chip and a switch output terminal of the second constant current boosting chip, a boosting switch terminal of the second constant current boosting chip is configured to receive the black insertion control signal through an inverter, a switch output terminal of the second constant current boosting chip is connected with the first electrode of the backlight module, and a negative electrode output terminal of the second constant current boosting chip and the second electrode of the backlight module are connected with the compensation gating sub-circuit.

6. The current compensation circuit according to claim 5, wherein the second constant current sub-circuit further comprises a second energy storage capacitor, and wherein an electrical connection point, between the switch output terminal of the second constant current boosting chip and the first electrode of the backlight module, is grounded through the second energy storage capacitor.

7. The current compensation circuit according to claim 6, wherein the second constant current sub-circuit further comprises a second diode which is configured to prevent flowing back of electric current, a positive electrode of the second diode is connected with the switch output terminal of the second constant current boosting chip, and a negative electrode of the second diode is grounded through the second energy storage capacitor.

8. The current compensation circuit according to claim 6, further comprising a third diode which is configured to prevent flowing back of electric current, a negative electrode of the third diode is connected with the first electrode of the backlight module, and a positive electrode of the third diode is grounded through the second energy storage capacitor.

9. The current compensation circuit according to claim 5, wherein the compensation gating sub-circuit comprises a first switching transistor, a second switching transistor, a third switching transistor and a fourth switching transistor, a first operational amplifier, a second operational amplifier, a first resistor and a second resistor, a drain electrode of the first switching transistor is connected with a drain electrode of the second switching transistor, a gate electrode of the second switching transistor is connected with the drain electrode of the second switching transistor, a source electrode of the second switching transistor is configured to receive a reference voltage, an electrical connection point between a source electrode of the first switching transistor and an inverting input terminal of the first operational amplifier is grounded through the first resistor, a non-inverting input terminal of the first operational amplifier is configured to receive the black insertion control signal, an output terminal of the first operational amplifier is connected with a gate electrode of the first switching transistor, the gate electrode of the second switching transistor is connected with a gate electrode of the fourth switching transistor, a source electrode of the fourth switching transistor is configured to receive the reference voltage, a drain electrode of the fourth switching transistor is connected with an enable terminal of the second operational amplifier, a non-inverting input terminal of the second operational amplifier is configured to receive the black insertion control signal, an electrical connection point between an inverting input terminal of the second operational amplifier and a source electrode of the third switching transistor is grounded through the second resistor, an output terminal of the second operational amplifier is connected with a gate electrode of the third switching transistor, and a drain electrode of the third switching transistor is connected with the negative electrode output terminal of the second constant current boosting chip.

10. The current compensation circuit according to claim 9, wherein the first switching transistor and the third switching transistor are N-typed transistors, and the second switching transistor and the fourth switching transistor are P-typed transistors.

11. A virtual reality device, comprising:

a liquid crystal display panel, and the current compensation circuit according to claim 1, wherein the liquid crystal display panel comprises the backlight module.

12. A control method of a current compensation circuit, wherein the current compensation circuit comprises:

a first constant current sub-circuit, configured to generate a driving current of a backlight module;

a second constant current sub-circuit, configured to generate a compensation current of the backlight module;

a compensation gating sub-circuit, connected with the second constant current sub-circuit, and configured to determine, according to a level of a black insertion control signal, whether to select the second constant current sub-circuit to supply power to the backlight module; and a black insertion control signal generation sub-circuit, configured to generate the black insertion control signal, connected with the first constant current sub-circuit and the compensation gating sub-circuit, and configured to control, by the black insertion control signal, the first constant current sub-circuit and the second constant current sub-circuit to simultaneously supply power to or power off the backlight module, so that the backlight module realizes a backlight black insertion, the control method comprises:

in a case where the black insertion control signal is at a first electrical level, controlling the first constant current sub-circuit to supply power to the backlight module, and simultaneously controlling the second constant current sub-circuit to supplementally supply power to the backlight module; and in a case where the black insertion control signal is at a second electrical level different from the first electrical level, controlling the first constant current sub-circuit to stop supplying power to the backlight module, and simultaneously controlling the second constant current sub-circuit to stop supplementally supplying power to the backlight module, so that the backlight module realizes the backlight black insertion.

13. The control method of the current compensation circuit according to claim 12, wherein the controlling the second constant current sub-circuit to stop supplementally supplying power to the backlight module comprises:

in a case where the black insertion control signal is at the second electrical level, controlling the second constant current sub-circuit to charge a second energy storage capacitor; and in the case where the black insertion control signal is at the second electrical level, cutting off a loop where an electrical energy of the second energy storage capacitor flows to the backlight module through a compensation gating sub-circuit.

14. The control method of the current compensation circuit according to claim 12, wherein the controlling the second constant current sub-circuit to supplementally supply power to the backlight module comprises:

in a case where the black insertion control signal is at the first electrical level, controlling the second constant current sub-circuit to stop charging a second energy storage capacitor; and in the case where the black insertion control signal is at the first electrical level, connecting a loop where an electrical energy of the second energy storage capacitor flows to the backlight module through a compensation gating sub-circuit, so that the second energy storage capacitor delivers an electrical energy to the backlight module.

15. A current compensation circuit, comprising a first constant current sub-circuit, a second constant current sub-circuit, an energy storage sub-circuit and a compensation gating sub-circuit, wherein the first constant current sub-circuit is configured to receive a black insertion control signal, and to provide a driving current to a backlight module in a case where the black insertion control signal is at a first electrical level;

the second constant current sub-circuit is connected with the energy storage sub-circuit and configured to receive the black insertion control signal, and the second constant current sub-circuit is configured to charge the energy storage sub-circuit in a case where the black insertion control signal is at a second electrical level different from the first electrical level; and the compensation gating sub-circuit is connected with the energy storage sub-circuit and the backlight module, and configured to receive the black insertion control signal, and the compensation gating sub-circuit is configured to make the energy storage sub-circuit discharge to the backlight module to provide a compensation current in a case where the black insertion control signal is at the first electrical level, and the compensation gating sub-circuit is configured to electrically disconnect the energy storage sub-circuit from the backlight module in a case where the black insertion control signal is at the second electrical level.

16. The current compensation circuit according to claim 15, further comprising a black insertion control signal generation sub-circuit, wherein the black insertion control signal generation sub-circuit is configured to generate the black insertion control signal.

17. The current compensation circuit according to claim 15, wherein the first constant current sub-circuit comprises a first constant current boosting chip, a first energy storage inductor, and a voltage regulating resistor, the first energy storage inductor is connected between a power input terminal of the first constant current boosting chip and a switch output terminal of the first constant current boosting chip, a regulating terminal of the first constant current boosting chip is grounded through the voltage regulating resistor, an output control terminal of the first constant current boosting chip is configured to receive the black insertion control signal, the switch output terminal of the first constant current boosting chip is connected with a first electrode of the backlight module, and a negative electrode output terminal of the first constant current boosting chip is connected with a second electrode of the backlight module.

18. The current compensation circuit according to claim 15, wherein the second constant current sub-circuit comprises a second constant current boosting chip, a second energy storage inductor and an inverter, the second energy storage inductor is connected between a power input terminal of the second constant current boosting chip and a switch output terminal of the second constant current boosting chip, a boosting switch terminal of the second constant current boosting chip is connected with a second terminal of the inverter, a first terminal of the inverter is configured to receive the black insertion control signal, the switch output terminal of the second constant current boosting chip is connected with a first electrode of the backlight module, and a negative electrode output terminal of the second constant current boosting chip is connected with a second electrode of the backlight module.

19. The current compensation circuit according to claim 18, wherein the energy storage sub-circuit comprises a second energy storage capacitor, a first electrode of the second energy storage capacitor is connected with the switch output terminal of the second constant current boosting chip, and a second electrode of the second energy storage capacitor is grounded.

20. The current compensation circuit according to claim 19, wherein the compensation gating sub-circuit comprises a fifth switching transistor, a gate electrode of the fifth switching transistor is configured to receive the black insertion control signal, a first electrode of the fifth switching transistor is connected with the first electrode of the second energy storage capacitor, and a second electrode of the fifth switching transistor is grounded.

* * * * *